US010377399B2

(12) United States Patent
Tatsumi et al.

(10) Patent No.: US 10,377,399 B2
(45) Date of Patent: Aug. 13, 2019

(54) TRAIN DATA TRANSMISSION SYSTEM AND TRAIN DATA TRANSMISSION PROGRAM

(71) Applicant: Mitsubishi Electric Corporation, Chiyoda-ku, Tokyo (JP)

(72) Inventors: Shogo Tatsumi, Tokyo (JP); Ryoichi Watanabe, Tokyo (JP); Tokiko Shibasaki, Tokyo (JP); Hiromi Goda, Tokyo (JP)

(73) Assignee: MITSUBISHI ELECTRIC CORPORATION, Chiyoda-ku, Tokyo (JP)

( * ) Notice: Subject to any disclaimer, the term of this patent is extended or adjusted under 35 U.S.C. 154(b) by 195 days.

(21) Appl. No.: 15/546,845

(22) PCT Filed: Apr. 20, 2015

(86) PCT No.: PCT/JP2015/062013
§ 371 (c)(1),
(2) Date: Jul. 27, 2017

(87) PCT Pub. No.: WO2016/170582
PCT Pub. Date: Oct. 27, 2016

(65) Prior Publication Data

US 2018/0022368 A1 Jan. 25, 2018

(51) Int. Cl.
*B61L 25/04* (2006.01)
*B61L 15/00* (2006.01)

(52) U.S. Cl.
CPC ..... *B61L 15/0072* (2013.01); *B61L 15/009* (2013.01); *B61L 15/0027* (2013.01);
(Continued)

(58) Field of Classification Search
None
See application file for complete search history.

(56) References Cited

U.S. PATENT DOCUMENTS 5,353,413 A * 10/1994 Novakovich ..... B61L 15/0036 701/117
7,256,789 B1 8/2007 Nakamura et al.
(Continued)

FOREIGN PATENT DOCUMENTS

EP 2 591 974 A2 5/2013
JP H-8-33106 A 2/1996
(Continued)

OTHER PUBLICATIONS

International Search Report (PCT/ISA/210) dated Jun. 9, 2015, by the Japanese Patent Office as the International Searching Authority for International Application No. PCT/JP2015/062013.
(Continued)

*Primary Examiner* — Shelley Chen
(74) *Attorney, Agent, or Firm* — Buchanan Ingersoll & Rooney PC

(57) ABSTRACT

In the train data transmission system for a train including a plurality of cars, a front car of the train includes: a front car control device that is a central control device configured to send and receive data to and from a control device of a train information management device installed in a following car; an on-board instrument configured to send state information to the front car control device, and receive a control command from the front car control device; and a display device configured to request data from the front car control device using a transmission data format, and receive the data from the front car control device in accordance with the transmission data format. An address is assigned only to data of the front car in the transmission data format, and the display device allocates data of the following car in sequence.

3 Claims, 8 Drawing Sheets

(52) U.S. Cl.
CPC ..... *B61L 15/0036* (2013.01); *B61L 15/0081* (2013.01); *B61L 25/04* (2013.01)

(56) References Cited

U.S. PATENT DOCUMENTS 8,037,204 B2 * 10/2011 Breton ..... B61L 15/0036 709/238
8,483,893 B2 * 7/2013 Karg ..... B61L 25/028 340/988
9,132,845 B2 * 9/2015 Kraeling ..... B61L 15/0036
9,813,503 B2 * 11/2017 Shigeeda ..... H04L 61/2015
2006/0180709 A1 * 8/2006 Breton ..... B61L 15/0036 246/1 C
2010/0215288 A1 8/2010 Ushiku
2012/0316708 A1 * 12/2012 Kraeling ..... H04L 61/2038 701/19
2012/0316764 A1 * 12/2012 Kraeling ..... B61L 15/0036 701/117
2012/0317282 A1 * 12/2012 Kraeling ..... H04L 12/40 709/224
2014/0032734 A1 * 1/2014 Shigeeda ..... H04L 61/2015 709/223
2014/0185619 A1 * 7/2014 Shigeeda ..... H04L 12/28 370/392
2014/0222982 A1 * 8/2014 Shigeeda ..... H04L 61/2007 709/222
2014/0344477 A1 * 11/2014 Shigeeda ..... H04L 61/2038 709/245
2015/0074277 A1 * 3/2015 Shigeeda ..... H04L 12/40006 709/226
2017/0214653 A1 * 7/2017 Shigeeda ..... H04L 12/28

FOREIGN PATENT DOCUMENTS

JP 10-063238 A 3/1998
JP 10-207446 A 8/1998
JP 2001-154945 A 6/2001
JP 2001-358919 A 12/2001
JP 2004-201476 A 7/2004
JP 2010-199744 A 9/2010
JP 2011-205777 A 10/2011
JP 2013-102624 A 5/2013

OTHER PUBLICATIONS

Written Opinion (PCT/ISA/237) dated Jun. 9, 2015, by the Japanese Patent Office as the International Searching Authority for International Application No. PCT/JP2015/062013.

* cited by examiner

FIG.4

CONTROL DEVICE NUMBERS

| | CONTROL DEVICE 1 | CONTROL DEVICE 2 | CONTROL DEVICE 3 | CONTROL DEVICE 4 | CONTROL DEVICE 5 | ... | CONTROL DEVICE 10 |
|---|---|---|---|---|---|---|---|
| DOOR | 8 | 8 | 8 | 8 | 8 | | 8 |
| MASTER CONTROLLER | 1 | 0 | 0 | 1 | 1 | | 1 |
| AIR CONDITIONING | 2 | 0 | 2 | 0 | 2 | | 0 |
| VVVF | 0 | 2 | 0 | 2 | 0 | | 0 |
| BRAKE | 1 | 1 | 1 | 1 | 1 | | 1 |
| SIV | 0 | 0 | 1 | 0 | 0 | | 0 |

NAMES OF MONITORED AND CONTROLLED INSTRUMENTS

FIG.5

SYSTEM CONFIGURATIONS

| NAMES OF FORMATION PATTERNS | | | | | | | | |
|---|---|---|---|---|---|---|---|---|
| 4-CAR TRAIN | CONTROL DEVICE 1 | CONTROL DEVICE 2 | CONTROL DEVICE 3 | CONTROL DEVICE 4 | | | | |
| 3-CAR TRAIN | CONTROL DEVICE 5 | CONTROL DEVICE 6 | CONTROL DEVICE 7 | | | | | |
| 7-CAR TRAIN | CONTROL DEVICE 1 | CONTROL DEVICE 2 | CONTROL DEVICE 3 | CONTROL DEVICE 4 | CONTROL DEVICE 5 | ... | | |
| 10-CAR TRAIN | CONTROL DEVICE 1 | CONTROL DEVICE 2 | CONTROL DEVICE 3 | CONTROL DEVICE 4 | CONTROL DEVICE 5 | ... | CONTROL DEVICE 10 | |

FIG.6

| DATA SPECIFYING DETAILED INFORMATION | | TRANSMISSION DATA STORAGE INFORMATION | |
|---|---|---|---|
| DATA NAME | CAR | ADDRESS | SIZE |
| ANNOUNCEMENT ON/OFF | 1 | 0x000 | 1 BYTE |
| ANNOUNCEMENT ON/OFF | 2 | 0x001 | 1 BYTE |
| ANNOUNCEMENT ON/OFF | 3 | 0x002 | 1 BYTE |
| ANNOUNCEMENT ON/OFF | 4 | 0x003 | 1 BYTE |
| DOOR OPEN/CLOSE | 1 | 0x004 | 1 BYTE |
| DOOR OPEN/CLOSE | 2 | 0x005 | 1 BYTE |
| DOOR OPEN/CLOSE | 3 | 0x006 | 1 BYTE |
| DOOR OPEN/CLOSE | 4 | 0x007 | 1 BYTE |

FIG.7

| DATA SPECIFYING DETAILED INFORMATION | | TRANSMISSION DATA STORAGE INFORMATION | |
|---|---|---|---|
| DATA NAME | CAR | INITIAL ADDRESS | SIZE |
| ANNOUNCEMENT ON/OFF | ALL CARS | 0x000 | 1 BYTE |
| DOOR OPEN/CLOSE | ALL CARS | 0x004 | 1 BYTE |

| | COMPARATIVE EXAMPLE | PRESENT INVENTION |
|---|---|---|
| ELEMENT A | 10 BYTES | 1 BYTE |
| ELEMENT B | 10 BYTES | 1 BYTE |
| ELEMENT C | 10 BYTES | 1 BYTE |
| ELEMENT D | 5 BYTES | 1 BYTE |
| TOTAL | 35 BYTES | 4 BYTES |

TRAIN DATA TRANSMISSION SYSTEM AND TRAIN DATA TRANSMISSION PROGRAM

FIELD

The present invention relates to a train data transmission system and a train data transmission program for a train including a plurality of cars.

BACKGROUND

Patent Literature 1 that is an example of a conventional technique discloses a car monitoring device for the purpose of "reducing the amount of data stored in the monitoring device, variably displaying data required for display on a car-by-car basis in accordance with the formation associated with the identification information for identifying the formation of cars, regardless of the type of formation of cars, and improving the performance of the monitoring device". The car monitoring device includes: a unit configured to store in advance identification information for identifying a formation of cars including a combination of cars and instruments installed in the respective cars, and to store in advance data required for display in connection with each car; a unit configured to set the identification information of the formation of cars; a unit configured to select and edit data required for display of the cars that constitute the formation in accordance with the identification information; and a unit configured to display the data required for display in association with the cars that constitute the formation based on data for variable display of each screen.

CITATION LIST

Patent Literature

Patent Literature 1: Japanese Patent Application Laid-Open No. H8-33106

SUMMARY

Technical Problem

However, according to the above-mentioned conventional technique, in a case where the formation of cars including a combination of cars and instruments installed in the respective cars is changed due to a change in the length of the formation of cars, replacement of cars or the like, the amount of data stored in the monitoring device can be reduced by handling data required for display on a car-by-car basis in accordance with the change in the formation of cars, but the amount of transmission data cannot be reduced. This causes the following problem: The load on a line cannot be reduced, and the speed of data transmission cannot be increased.

The present invention has been made in consideration of the above circumstances, and an object thereof is to obtain a train data transmission system capable of reducing the amount of transmission data and increasing the speed of data transmission.

Solution to Problem

To solve the above described problems and achieve the object a train data transmission system for a train according to the present invention includes a plurality of cars. A front car of the train includes: a front car control device that is a central control device to send and receive data to and from a control device of a train information management device installed in a following car; an on-board instrument to send state information to the front car control device, and receive a control command from the front car control device; and a display device to request data from the front car control device using a transmission data format, and receive the data from the front car control device in accordance with the transmission data format. An address is assigned only to data of the front car in the transmission data format, and the display device allocates data of the following car in sequence.

Advantageous Effects of Invention

The present invention can achieve an effect of reducing the amount of transmission data and increasing the speed of data transmission.

BRIEF DESCRIPTION OF DRAWINGS

FIG. 4 is a diagram illustrating an example of instrument arrangement information stored in an instrument arrangement information storage unit of a 10-car train according to the embodiment.

FIG. 5 is a diagram illustrating an example of system configuration information stored in a system configuration information storage unit according to the embodiment.

FIG. 6 is a diagram illustrating a comparative example of information that is sent and received between the control device and the display device according to the embodiment.

FIG. 7 is a diagram illustrating an example of information that is sent and received between the control device and the display device according to the embodiment.

DESCRIPTION OF EMBODIMENTS

Hereinafter, a train data transmission system and a train data transmission program according to an embodiment of the present invention will be described in detail based on the drawings. The present invention is not limited to the embodiment.

Embodiment

Figure 1:
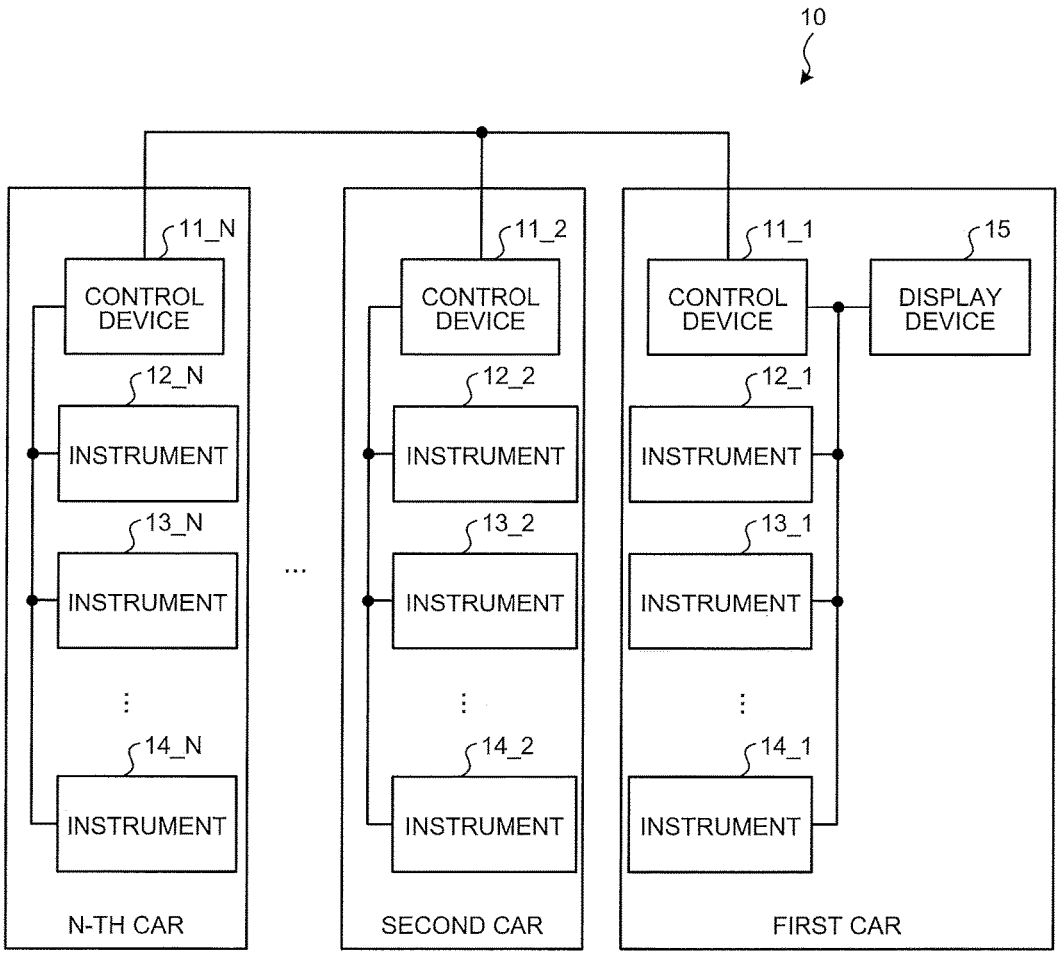
FIG. 1 is a diagram illustrating a train formation according to an embodiment.

FIG. 1 is a diagram illustrating a train formation according to an embodiment of the present invention. A train 10 illustrated in FIG. 1 is an N-car train including first to N-th cars. Note that N is a natural number of three or more. The first car, that is, the front car, includes: a control device 11_1 which is a central control device of a train information management device and also being a front car control device; instruments 12_1, 13_1, and 14_1 which are on-board instruments; and a display device 15. The second car includes a control device 11_2 and instruments 12_2, 13_2, and 14_2 which are on-board instruments. The N-th car includes a control device 11_N and instruments 12_N, 13_N, and 14_N which are on-board instruments. The control devices 11_1, 11_2, and 11_N are communicably connected to one another. Each control device is communicably connected to a plurality of on-board instruments installed in each car to monitor and control the plurality of on-board instruments. For example, the control device 11_1 is communicably connected to the instruments 12_1, 13_1, and 14_1 installed in the first car to monitor and control the instruments 12_1, 13_1, and 14_1. The instruments 12_1, 13_1, and 14_1 can be exemplified by a door, an air-conditioning control device, and a brake. In the first car, the instrument can also be exemplified by a master controller which is referred to as a mascon.

In the second to N-th cars, that is, cars other than the front car, each of the control devices 11_2 and 11_N receives state information of each on-board instrument in the car, and sends the state information to the control device 11_1 that is the central control device. The control device 11_1 sends a control command in accordance with the received state information of each of the plurality of on-board instruments. More specifically, the control device 11_1: sends control commands to the instruments 12_1, 13_1, and 14_1 in accordance with the received pieces of state information of the instruments 12_1, 13_1, and 14_1; sends control commands to the instruments 12_2, 13_2, and 14_2 via the control device 11_2 in accordance with the pieces of state information of the instruments 12_2, 13_2, and 14_2 received from the control device 11_2; and sends control commands to the instruments 12_N, 13_N, and 14_N via the control device 11_N in accordance with the pieces of state information of the instruments 12_N, 13_N, and 14_N received from the control device 11_N.

In this manner, the control devices 11_1 to 11_N constitute a distributed control system for the train, and the control device 11_1 collects monitoring control information of the on-board instrument. The monitoring control information is monitoring information and control information, the monitoring information is the state information of the on-board instrument, and the control information is control command information for the on-board instrument. Hereinafter, the monitoring control information of the instrument is referred to as instrument information.

The display device 15 is provided in a driver's cab (not illustrated) in the first car which is the front car. The display device 15 is connected to the control device 11_1, and the instrument information of the on-board instrument in each car is input from the control device 11_1 to the display device 15. The display device 15 can collect the instrument information of the on-board instrument in each car to display the instrument information on a display screen. The pieces of instrument information collected from the respective on-board instruments are also referred to as car information. Although the display device is provided only in the first car in the present embodiment, the present invention is not limited to this example, and the N-th car may also include a display device. The train may be configured to be operable as a shuttle train which travels in the opposite direction, with the N-th car serving as the front car.

Figure 2:
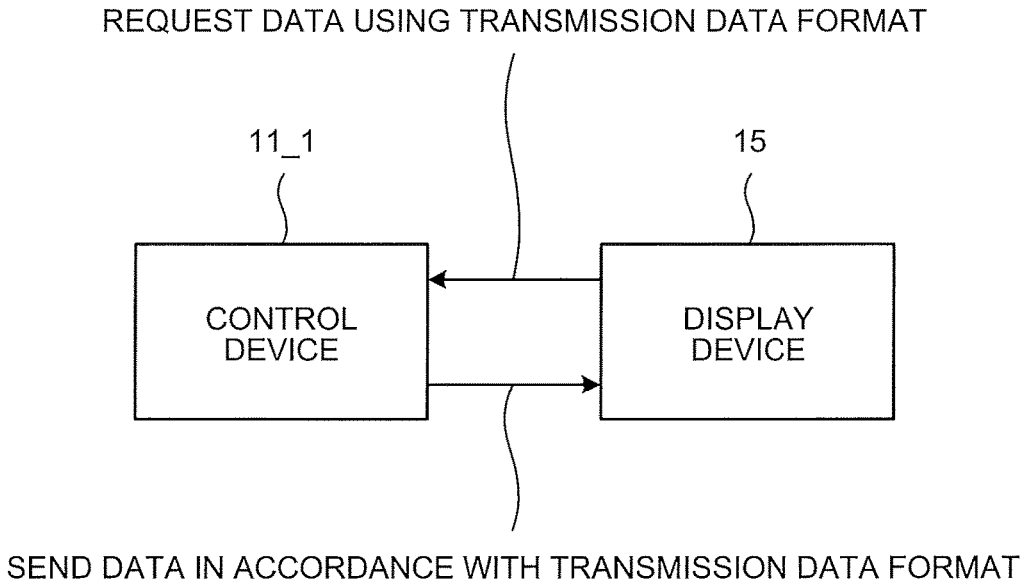
FIG. 2 is a diagram illustrating operation of a control device, or a central control device, and a display device according to the embodiment.

FIG. 2 is a diagram illustrating operation of the control device 11_1 being the central control device, and the display device 15. The display device 15 illustrated in FIG. 2 requests data from the control device 11_1 using a transmission data format, and the control device 11_1 sends the data to the display device 15 in accordance with the transmission data format. The transmission data format is a frame suitable for a process that is performed in the display device 15 when the display device 15 requests data from the control device 11_1. The control device 11_1 puts the data in the frame and sends it back to the display device 15.

Figure 3:
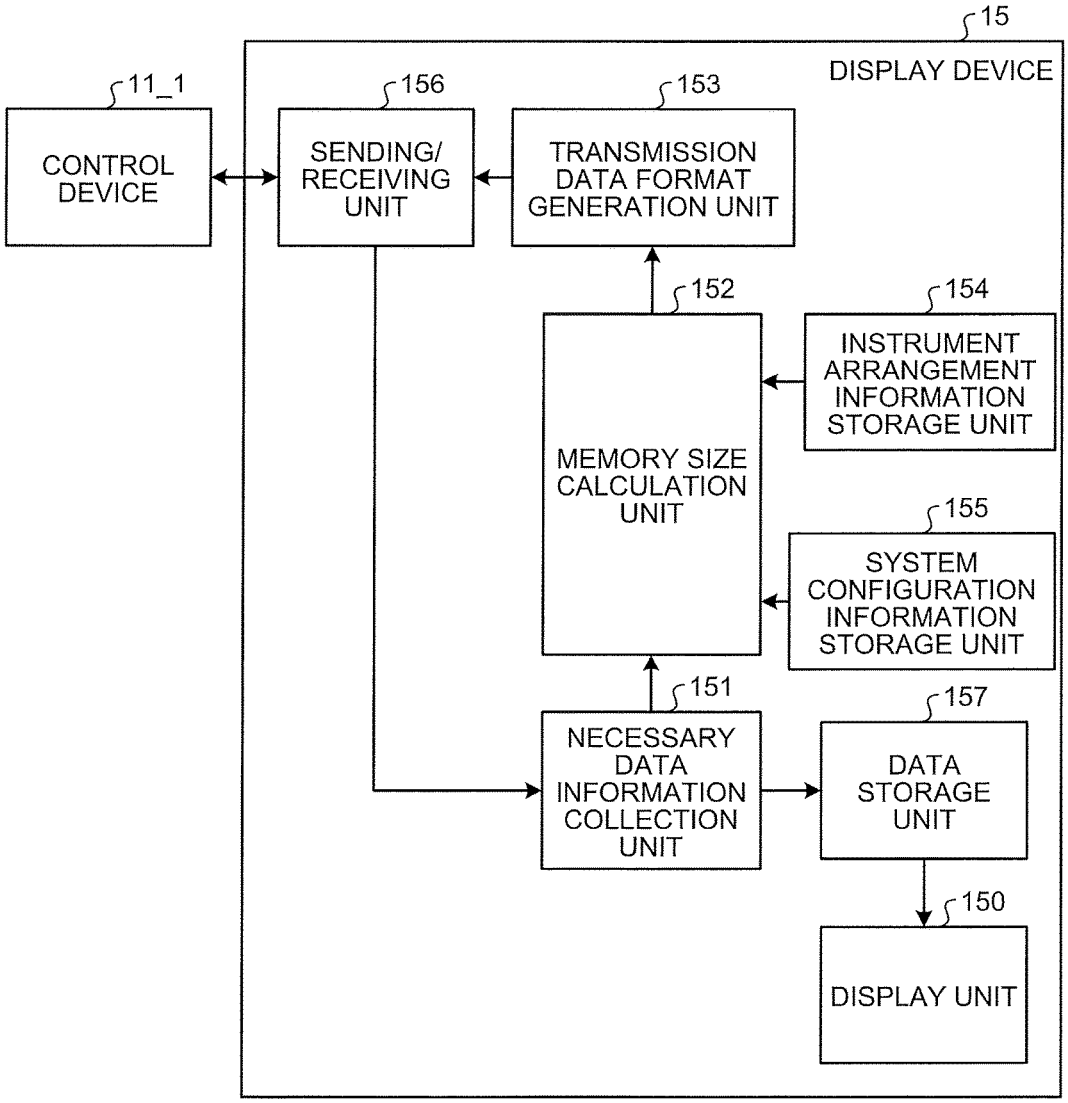
FIG. 3 is a diagram illustrating a configuration of the display device according to the embodiment.

FIG. 3 is a diagram illustrating a configuration of the display device 15. The display device 15 illustrated in FIG. 3 includes: a display unit 150 that displays information on the on-board instrument in the train 10; a necessary data information collection unit 151 that determines data to be collected for a display process in the display unit 150, and outputs the result to the memory size calculation unit 152; a memory size calculation unit 152 that calculates a memory size by calculating, from the input result, the number of pieces of data to be collected, and outputs the calculation result to a transmission data format generation unit 153; the transmission data format generation unit 153 that generates a transmission data format in accordance with the calculation result calculated by the memory size calculation unit 152; an instrument arrangement information storage unit 154 that is connected to the memory size calculation unit 152 and stores instrument arrangement information therein; a system configuration information storage unit 155 connected to the memory size calculation unit 152 and stores system configuration information therein; a sending/receiving unit 156 that requests data from the control device 11_1 using the transmission data format generated by the transmission data format generation unit 153 and receives the transmission data format sent back from the control device 11_1 with the data written thereto; and a data storage unit 157 that stores the data via the necessary data information collection unit 151 using the transmission data format sent back.

In the display unit 150, the display process is performed in accordance with the data stored in the data storage unit 157.

FIG. 4 is a diagram illustrating an example of the instrument arrangement information stored in the instrument arrangement information storage unit 154 of a 10-car train. In the instrument arrangement information illustrated in FIG. 4, control device numbers and names of monitored and controlled instruments that are monitored and controlled by each control device are described as items. The names of monitored and controlled instruments are exemplified by a door, a master controller, air conditioning, a variable voltage variable frequency (VVVF), a brake, and a static inverter (SIV). The VVVF represents a variable voltage variable frequency inverter which is a' VVVF inverter, and the SIV represents a static inverter which is also referred to as an auxiliary power unit (APU). In FIG. 4, a control device 1 corresponds to the control device 11_1 in FIG. 1, a control device 2 corresponds to the control device 11_2 in FIG. 1, and a control device 10 corresponds to the control device 11_N assuming that N=10 is satisfied in FIG. 1. In addition, "8" described in the row "door" represents the number of doors in each car, "1" or "0" described in the row "master controller" represents the number of master controllers in each car, "2" or "0" described in the row "air conditioning" represents the number of air conditioners in each car, "2" or "0" described in the row "VVVF" represents the number of VVVF inverters in each car, "1" described in the row "brake" represents the number of brakes in each car, and "1" or "0" described in the row "SIV" represents the number of SIV inverters in each car.

FIG. 5 is a diagram illustrating an example of the system configuration information stored in the system configuration information storage unit 155. In the system configuration information illustrated in FIG. 5, system configurations of the control devices are described in association with names of formation patterns. The names of formation patterns are exemplified by a "4-car train", a "3-car train", a "7-car train" and a "10-car train" in accordance with the number of cars that constitute the train. The system configuration of the "4-car train" includes the control devices 1, 2, 3, and 4, and the system configuration of the "3-car train" includes the control devices 5, 6, and 7. The system configuration of the "7-car train" is obtained by coupling the "4-car train" and the "3-car train". The control devices 6, 7, 8, and 9 are omitted from FIG. 5 in the "7-car train" and in the "10-car train". In the "3-car train" in FIG. 5, the control device 5 corresponds to the control device 11_1.

FIG. 6 is a diagram illustrating a comparative example of information that is sent and received between the control device 11_1 and the display device 15. FIG. 7 is a diagram illustrating an example of information that is sent and received between the control device 11_1 and the display device 15 according to the present embodiment. In FIGS. 6 and 7, data specifying detailed information includes data names and car numbers, and transmission data storage information includes addresses and sizes of the pieces of data. In this example, the "data name" is exemplified by "announcement on/off" and "door open/close". In FIGS. 6 and 7, the number of cars in the train formation is four.

In FIG. 6, the address "0x000" of the transmission data storage information is allocated to the information on announcement on/off in the first car, the address "0x001" of the transmission data storage information is allocated to the information on announcement on/off in the second car, the address "0x002" of the transmission data storage information is allocated to the information on announcement on/off in the third car, and the address "0x003" of the transmission data storage information is allocated to the information on announcement on/off in the fourth car. In addition, the address "0x004" of the transmission data storage information is allocated to the information on door open/close in the first car, the address "0x005" of the transmission data storage information is allocated to the information on door open/close in the second car, the address "0x006" of the transmission data storage information is allocated to the information on door open/close in the third car, and the address "0x007" of the transmission data storage information is allocated to the information on door open/close in the fourth car. In the comparative example, as illustrated in FIG. 6, each piece of information that is sent and received between the control device 11_1 and the display device 15 has its own address. However, if addresses are given to all the pieces of data that are sent and received as described above, the size of the frame that is the transmission data format is increased due to the address information, resulting in an increase in the amount of transmission data and a strain on the memory capacity.

In this regard, the configuration illustrated in FIG. 7 is employed: the car numbers of the data specifying detailed information are set to "all cars", only an initial address which is the address of the first car in each data name is designated, and the display device 15 refers to formation information to allocate the data in order of car numbers. Since all cars are enabled to be designated as illustrated in FIG. 7, and data are allocated to each car on the reception side, addresses other than the initial address do not need to be included in the transmission data format, and the size of the transmission data format can be reduced.

Figures 8, 9:
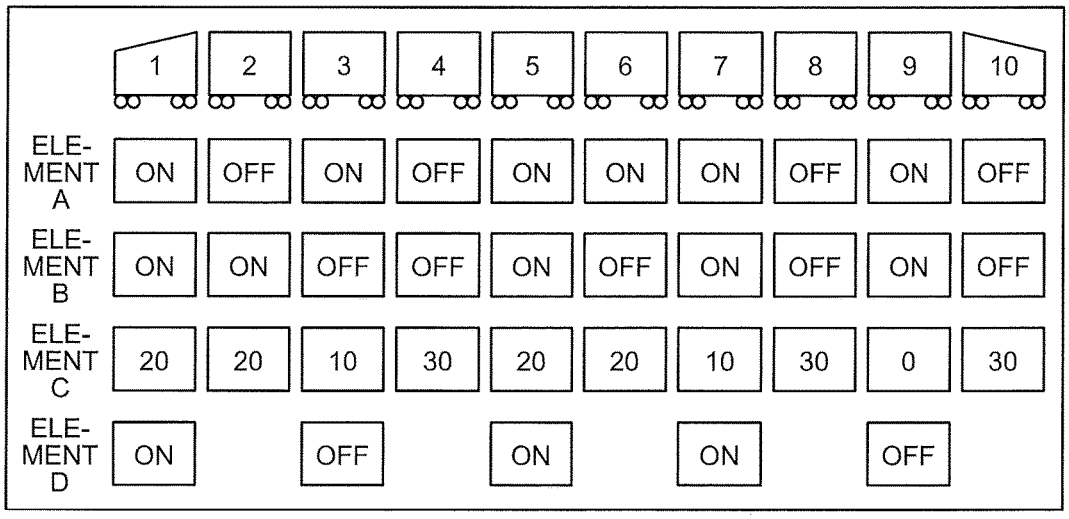
FIG. 8 is a diagram illustrating an example of a display screen displayed on the display device according to the embodiment.
FIG. 9 is a diagram for comparing the data size of the comparative example and the data size of the present invention according to the present embodiment.

FIG. 8 is a diagram illustrating an example of the display screen displayed on the display device 15. In FIG. 8, the train 10 is a 10-car train, and elements A, B, C, and D are indicated as items on the display device 15. An example of the element A is broadcast on/off, an example of the element B is door open/close, an example of the element C is an air conditioning set temperature, and an example of the element D is a brake.

FIG. 9 is a diagram for comparing the total data size of the elements A, B, C, and D of the comparative example and the total data size of the elements A, B, C, and D of the present invention in relation to the example of FIG. 8. In the comparative example illustrated in FIG. 9, each of the addresses of the elements A, B, and C has a data size of 10 bytes, the address of the element D has a data size of 5 bytes, and the total data size reaches 35 bytes. In contrast, in the present invention, each of the addresses of the elements A, B, C, and D has a data size of 1 byte, and the total data size is 4 bytes. As can be seen from this example, the data size of the address of each element can be significantly reduced according to the present invention. In the example illustrated in FIGS. 8 and 9, the total data size of the addresses of the elements A, B, C, and D can be reduced by 89%.

As described above, according to the present embodiment, addresses other than the initial address do not need to be included in the transmission data format, and the size of the transmission data format can be reduced. Therefore, the amount of transmission data can be reduced, and the speed of data transmission can be increased.

Figure 10:
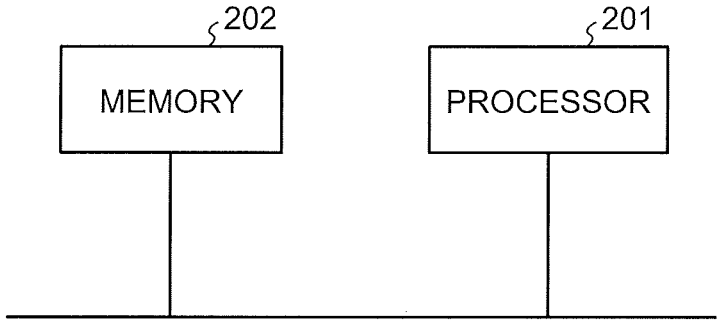
FIG. 10 is a diagram illustrating a typical configuration of hardware for realizing the present invention.

In the above-described embodiment, each of the control devices 11_1, 11_2, and 11_N and the display device 15 includes at least a processor and a memory, and the operation of each device can be realized by software. FIG. 10 is a diagram illustrating a typical configuration of hardware for realizing each of these devices. The device illustrated in FIG. 10 includes a processor 201 and a memory 202. The processor 201 performs computation and control with the aid of software using input data. The memory 202 stores the input data or data required for the processor 201 to perform computation and control. Note that a plurality of processors 201 and a plurality of memories 202 may be provided.

An aspect of the present invention is a train data transmission program that is executed by a computer including a processor and a memory. A train data transmission program according to an aspect of the present invention is a train data transmission program for controlling data transmission between a central control device of a train information management device provided in a front car of a train including a plurality of cars and a display device, and the program is designed to cause a computer to execute: a step of determining, by a necessary data information collection unit of the display device, data to be collected and outputting a result of determination to a memory size calculation unit of the display device; a step of calculating, by the memory size calculation unit in response to receiving input of the result, a memory size by calculating, from the result, the number of pieces of data to be collected, and outputting a calculation result to a transmission data format generation unit of the display device; a step of generating, by the transmission data format generation unit in response to receiving input of the calculation result, a transmission data format in accordance with the calculation result, and requesting data from the central control device using the transmission data format; a step of storing, in response to receiving the transmission data format sent back from the central control device with the data written to the transmission data format, the data in a data storage unit of the display device via the necessary data information collection unit using the transmission data format sent back; and a step of performing, by the data storage unit, a display process on a display unit of the display device in accordance with the data.

In the above-described embodiment, the number of cars that constitute the train is three or more. However, the present invention is not limited to this example, and can also be applied to a train including two cars. It should be understood, however, that the present invention is more advantageous to a larger number of cars.

The configuration described in the above-mentioned embodiment indicates an example of the contents of the present invention. The configuration can be combined with another well-known technique, and a part of the configuration can be omitted or changed in a range not departing from the gist of the present invention.

REFERENCE SIGNS LIST

10 train, 11_1, 11_2, 11_N control device, 12_1, 12_2, 12_N, 13_1, 13_2, 13_N, 14_1, 14_2, 14_N instrument, display device, 150 display unit, 151 necessary data information collection unit, 152 memory size calculation unit, 153 transmission data format generation unit, 154 instrument arrangement information storage unit, 155 system configuration information storage unit, 156 sending/receiving unit, 157 data storage unit, 201 processor, 202 memory.

The invention claimed is:

1. A train data transmission system for a train including a plurality of cars, wherein a front car of the train comprises:

a front car control device that is a central control device to send and receive data to and from a control device of a train information management device installed in a following car;

and a display device to request data from the front car control device using a transmission data format, and receive the data from the front car control device in accordance with the transmission data format, and an address is assigned only to data of the front car in the transmission data format, and the display device allocates data of the following car in sequence.

2. The train data transmission system according to claim 1, wherein the display device refers to formation information of the train to allocate the data of the following car in sequence.

3. The train data transmission system according to claim 1, wherein the transmission data format includes:

formation information in which data specifying detailed information of the plurality of cars is arranged for the front car to an N-th car in sequence; and addresses that show storage position in the transmission data format of the data specifying detailed information of the front car included in the formation information, wherein when the display device receives the data from the front car control device in accordance with the transmission data format, the display device allocates addresses that show storage position in the transmission data format of the following cars in sequence based on addresses that show storage position in the transmission data format of the data specifying detailed information of the front car and instrument arrangement information.

* * * * *